US008459957B2

(12) United States Patent
Takeda et al.

(10) Patent No.: US 8,459,957 B2
(45) Date of Patent: Jun. 11, 2013

(54) WATER-INJECTED COMPRESSOR

(75) Inventors: Fumio Takeda, Ushiku (JP); Hitoshi Nishimura, Shizuoka (JP); Natsuki Kawabata, Shizuoka (JP); Masakazu Aoki, Shizuoka (JP)

(73) Assignee: Hitachi Industrial Equipment Systems, Co., Ltd., Tokyo (JP)

( * ) Notice: Subject to any disclaimer, the term of this patent is extended or adjusted under 35 U.S.C. 154(b) by 1392 days.

(21) Appl. No.: 11/844,053

(22) Filed: Aug. 23, 2007

(65) Prior Publication Data

US 2008/0089795 A1 Apr. 17, 2008

(30) Foreign Application Priority Data

Oct. 16, 2006 (JP) ..... 2006-280869
Mar. 30, 2007 (JP) ..... 2007-090131

(51) Int. Cl.
*F04B 49/00* (2006.01)

(52) U.S. Cl.
USPC ..... 417/12; 417/18; 417/14; 417/32; 417/438

(58) Field of Classification Search
USPC ... 417/12, 290, 14, 32, 292, 438, 18; 418/100
See application file for complete search history.

(56) References Cited

U.S. PATENT DOCUMENTS

| | | | | |
|---|---|---|---|---|
| 5,174,741 | A * | 12/1992 | Tohgo | 418/84 |
| 5,240,179 | A * | 8/1993 | Drinkwater | 237/80 |
| 5,444,360 | A * | 8/1995 | Drinkwater | 323/265 |
| 5,544,645 | A * | 8/1996 | Armijo et al. | 126/101 |
| 5,836,754 | A * | 11/1998 | Ozaki et al. | 418/201.3 |
| 6,102,683 | A * | 8/2000 | Kirsten | 418/85 |
| 7,314,039 | B2 * | 1/2008 | Toniato | 123/497 |
| 7,481,060 | B2 * | 1/2009 | Haertel et al. | 60/775 |
| 2006/0231491 | A1 * | 10/2006 | Mukhopadhyay | 210/639 |

FOREIGN PATENT DOCUMENTS

| | | |
|---|---|---|
| EP | 0 974 754 A2 | 1/2000 |
| JP | 2000-45948 A | 2/2000 |
| JP | 2000-240573 | 9/2000 |

OTHER PUBLICATIONS

Chinese Office Action including English translation dated Mar. 20, 2009.
Belgian Search Report mailed Jan. 31, 2011.

* cited by examiner

*Primary Examiner* — Charles Freay
*Assistant Examiner* — Christopher Bobish
(74) *Attorney, Agent, or Firm* — Crowell & Moring LLP

(57) ABSTRACT

A water-injected compressor, which injects the water inside the separator 3 into the compressor and discharges the water along with compressed air into the separator and then gains condensed and separated water, has the compressor stopping and then, if staying at a stop for a predetermined duration of time without activating, becoming activated and operating for a set duration of time.

18 Claims, 6 Drawing Sheets

| ATMOSPHERE (INTAKE) TEMPERATURE Ts (°C) | PAUSING TIME DURATION toff (h) | OPERATING TIME DURATION ton (h) |
|---|---|---|
| Ts < 10 | 24 | 0.25 |
| 10 < Ts < 20 | 12 | 0.25 |
| 20 < Ts < 40 | 6 | 0.25 |

WATER-INJECTED COMPRESSOR

CLAIM OF PRIORITY

The present application claims priority from Japanese applications serial No. 2006-280869, filed on Oct. 16, 2006 and serial No. 2007-90131, filed on Mar. 30, 2007, the contents of which are hereby incorporated by reference into this application.

BACKGROUND OF THE INVENTION

1. Field of Technology

The present invention relates to a water-injected compressor into which water is injected and out of which water is discharged along with compressed air.

2. Background of Art

A water-injected compressor lubricates and seals itself by the water injected into the compressor. In order that the water discharged along with compressed air can be reused for the injection into the compressor, this water-injected compressor has a water circulating system in which water is circulated and then used. It is known that a long continuous operation with a low concentration of circulating water impurities without any water refill is achieved by supplying compressed air to a water tank, cooling down the compressed air out of the water tank and then supplying the condensed and separated water to the compressor with the remaining circulating water being drained from the water tank. An earlier patent disclosure dealing with this is found in Patent Document 1.

[Patent Document 1] Japanese Patent Laid-Open No. 2000-45948

SUMMARY OF THE INVENTION

According to the above-mentioned conventional art, while a compressor portion is being operated, bacteria/germs are prevented from growing by the constant supply of water condensed from compressed air and by the high pressure and temperature inside the compressor portion. But while the compressor portion stays at a stop, the duration causes the water inside the separator for separating air from water and inside the lines to near the temperature of the atmosphere, resulting in the possibility of ambient bacteria/germs growing in the remaining water in the separator and lines.

The period from spring to autumn when the atmosphere temperature is around 30° C. is particularly favorable to the propagation of bacteria/germs. When the compressor portion stays unused for a long duration of time, it is necessary to frequently exchange the water and also wash the equipment and lines against the propagation.

An object of the present invention, therefore, is to present a compressor portion capable of staying at a stop for a long duration of time while preventing bacteria/germs from growing in the separator, the compressor portion and the lines without necessitating for example water exchange before resuming of operation.

To achieve the above-mentioned object, according to the present invention, a water-injected compressor is provided which injects the water inside the separator into the compressor portion, discharges the water along with compressed air into the separator and then gains condensed and separated water and which stops and then, if staying at a stop for a predetermined duration of time without receiving an activation request (i.e. starting request), becomes activated and operates for a set duration of time.

According to embodiments of the present invention, it is possible to prevent bacteria/germs from growing in the compressor portion and the lines.

DETAILED DESCRIPTION OF THE INVENTION

Detailed Description of Preferred Embodiments of the Invention

Figure 1:
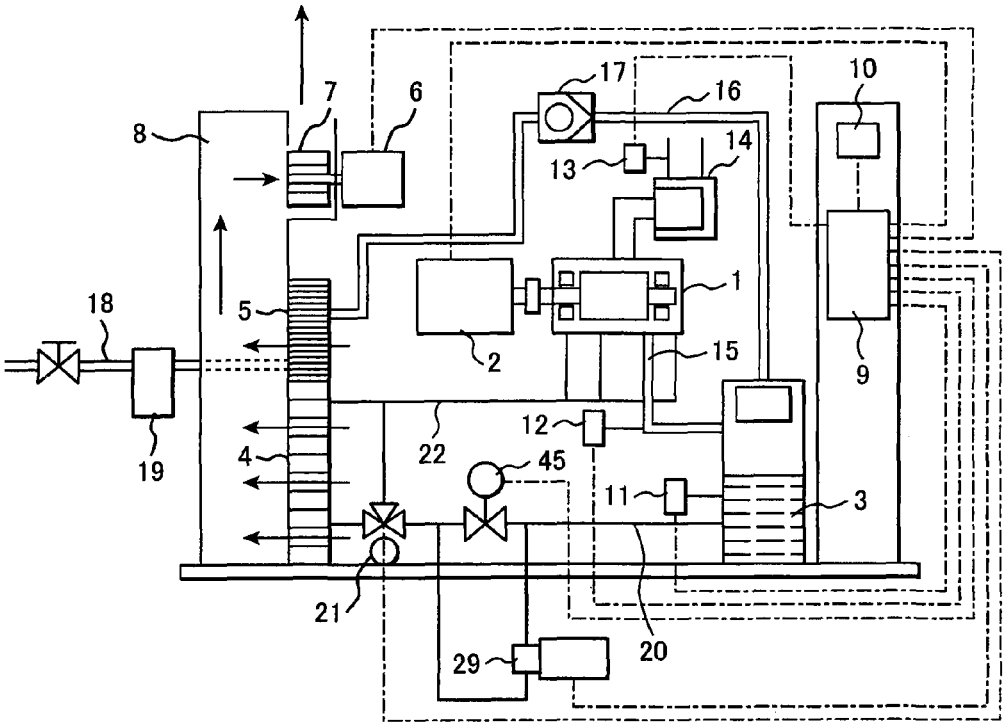
FIG. 1 is a block diagram illustrating an embodiment of the present invention.

Referring now to FIG. 1, there is shown the system composition of a water-injected compressor in an embodiment of the present invention. A compressor portion 1 is a positive displacement compressor. A screw compressor will be taken as an example in the following explanation.

The water in a separator 3 is supplied by the internal pressure of the separator 3 through a water supply line 20 connected to the separator 3 to the compressor 1. More concretely, the water is cooled down by an air-cooling water cooler 4 connected to the water supply line 20 is supplied through a water injection line 22 to the compression cavity of the compressor portion 1. The compressor portion 1, in which water lubricated bearings are used, is short of sufficient pressure to send water into the separator 3 at the time of the activation of the compressor portion 1, so a pump 29 provided between the water supply line 20 and the air-cooling water cooler 4 activates and increases the water from the separator 3 in pressure and supplies the water to the bearings of the water-injected compressor portion 1.

The compressor portion 1 takes air in through an admission port 14 having an inlet air filter, compresses the air, discharges the air from a discharge port not shown in the drawing to the separator 3 via a discharge line 15 along with the water injected during the compression process. The separator 3 separates water from the compressed air. The water is stored in the lower part of the separator 3 and then re-supplied through the water supply line 20 to the compressor portion 1.

The compressed air is separated by the separator 3, sent through an air discharge line 16 connected to the upper part of the separator 3, cooled down by an after cooler 5, separated from condensed drain (water) by a drain separator 19 and then discharged to an precinct line 18 for supplying compressed air.

Figures 2, 3:
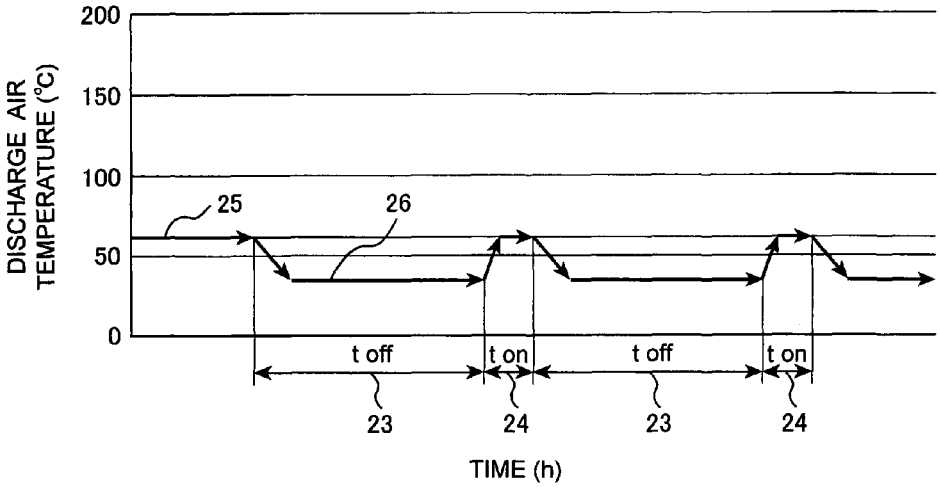
FIG. 2 is a graph showing the relation between pausing and operating time durations and discharge air temperatures in an embodiment of the present invention.
FIG. 3 is a graph showing the relations between atmosphere temperatures and pausing and operating time durations in an embodiment of the present invention.

At the time of a comparatively long stop, for example at night or on holidays, in other words when the compressor portion 1 stays at a stop without receiving an activation request from outside, the compressor portion 1, as shown in FIG. 2, when staying longer than a predetermined pausing time duration toff 23, becomes automatically activated and operates for a setting time duration ton 24 for the purpose of water quality control. Afterwards, the compressor portion 1 repeats pausing and operation until a water-injected compressor is restarted. The pausing and operation of the compressor will be further explained with reference to FIG. 1.

The water-injected compressor includes a console 9 for operating and controlling the entire unit. The console 9 allows driving the driving motor 2 of the water-injected compressor 1, a cooling fan motor 6 and the motor for the pump 29. The console 9 also allows operating a bypass-line solenoid valve 45 which opens and closes in accordance with the operation of the pump 29 for use in pressurizing water at the time of starting and a three-directions solenoid valve 21 for switching between the line for cooling the water supplied to the compressor 1 through the air-cooling water cooler 4 and the line for supplying water to the compressor 1 by keeping the water at a high temperature without being cooled down through the air-cooling water cooler 4.

The admission port 14 has an atmosphere temperature (intake air temperature) detection sensor 13, a separator temperature detection sensor 11 and a discharge air temperature detection sensor 12 for detecting the temperature of the air discharged by the compressor 1, by which the console 9 allows detecting the temperatures of the portions. In addition, using a timer 10 the console 9 allows measuring a starting time point and a stopping time point of the compressor portion 1. The console 9, as shown in FIG. 3, is provided with a memory device for storing the data resulting from the setting of operating time durations and pausing time durations for the compressor portion 1 in accordance with detected atmosphere (intake) temperatures.

Figure 4:
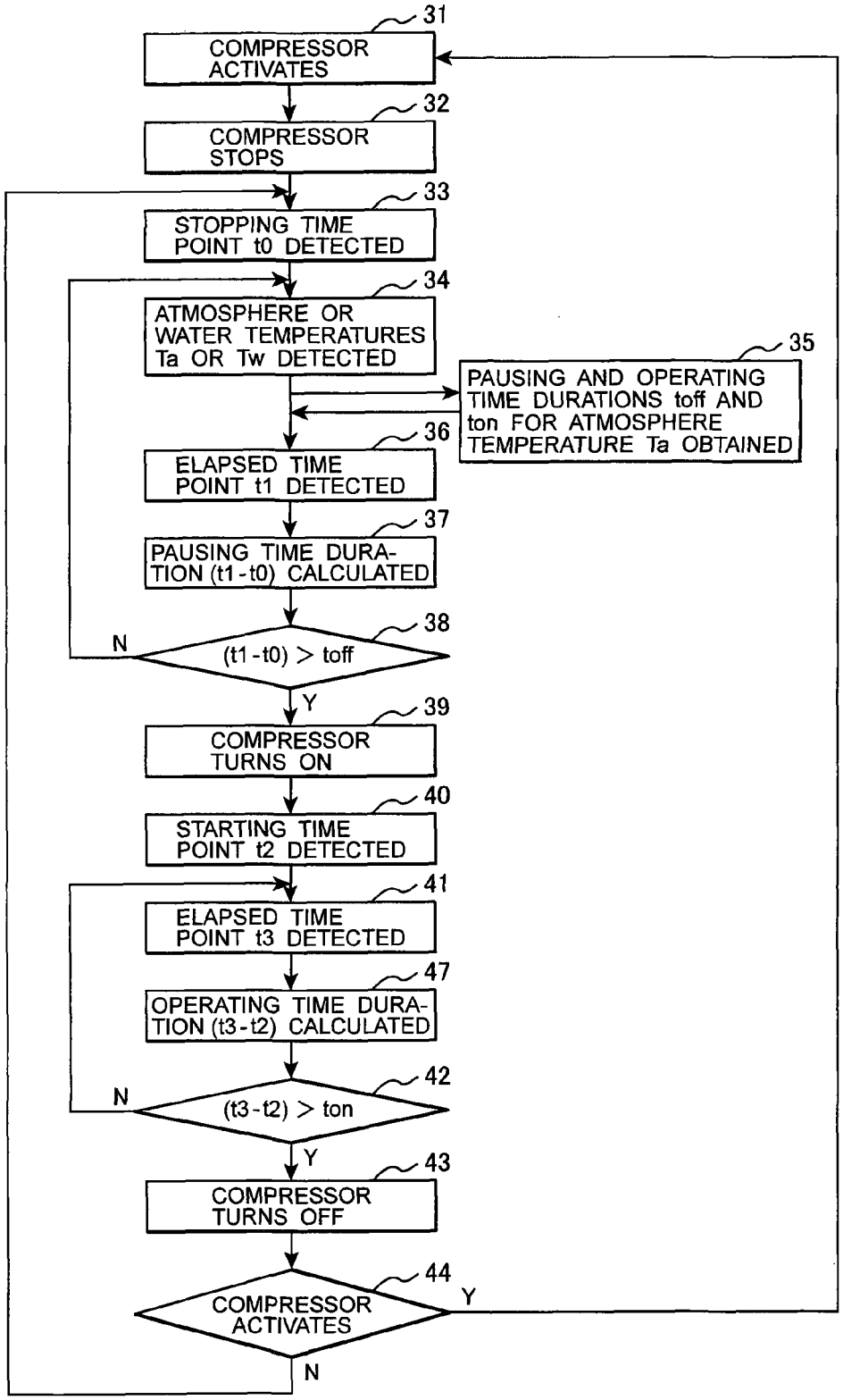
FIG. 4 is a flowchart representing the operation procedure in an embodiment of the present invention.
Figure 5:
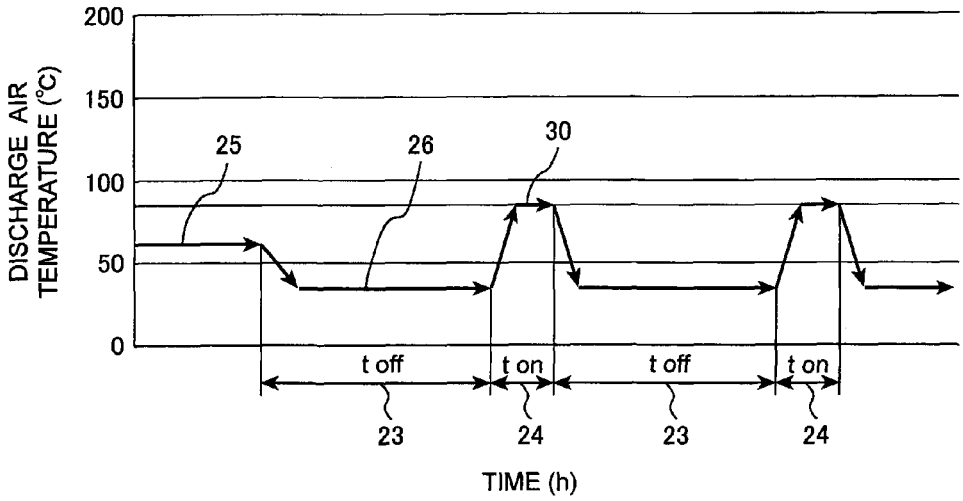
FIG. 5 is a graph showing the relation between pausing and operating time durations and discharge air temperatures.

Now, with reference to FIG. 4, the operation procedure for the water-injected compressor will be explained.

For a routine for ordinary operation, the compressor portion 1 activates (Step 31). When the daily operating time comes to an end, the compressor portion 1 stops (Step 32). Then, with the compressor portion 1 the timer 10 is employed to detect a stopping time point to (Step 33), and the result is stored in a memory device not shown in the drawing. Besides, atmosphere temperature (intake air temperature) Ta or separator water temperature Tw and detected (Step 34), and the result is stored in the same manner. The resultant atmosphere temperature Ta and water temperature Tw are used based on the data stored in the memory device to set a pausing time duration toff and an operating time duration ton of the compressor portion 1 for the atmosphere temperature Ta or for the water temperature Tw (Step 35). Afterwards, the timer 10 is employed to detect an elapsed time point t1 (Step 36) and to calculate the pausing time duration (Step 37). If the pausing time duration exceeds the set time duration (Step 38), the water-injected compressor activates (Step 39).

When the pausing time duration does not exceed the set time duration, the procedure follows around the loop starting from Step 34 "Atmosphere (Intake) Temperature and Water Temperature Detection." When the compressor portion 1 activates, a starting time point t2 is detected (Step 40), and the result is stored. Then, an elapsed time point t3 is detected (Step 41), and the operating time duration is calculated (Step 47). The calculated operating time duration is compared with the set operating time duration ton (Step 42). If the operating time duration exceeds the set time duration, the water-injected compressor stops (Step 43).

Afterwards, it is decided whether or not the water-injected compressor has its ordinary activation switch (starting switch) for requiring activation pressed (Step 44). If the ordinary activation switch is pressed, the ordinary continuous operation starts (Step 31). If the switch is not pressed, the repetition of pause and operation starts for water quality control (the procedure goes back to Step 33).

When after stopping the compressor portion 1 operates for water quality control, it is desirable that the sterilization effect on water should be increased by the operation with the discharge air temperature higher than in ordinary operation. Concretely, it is ordinary that feed water before being fed is cooled down by the air-cooling water cooler 4 shown in FIG. 1, but operating the three-directions solenoid valve 21 allows the water not to go through the water cooler 4 but to go directly to the compressor portion 1. This makes it possible to increase the temperature of the water into a high temperature, adding to the sterilization effect on the water. Here, the operation at a discharge air temperature of 85° C. or higher (namely the water temperature for the discharge takes a like value) for 15 minutes or longer ensures the sterilization effect on the water.

Note that, in order that after reaching a set temperature the discharge air temperature cannot become too high, it is desirable that the three-directions solenoid valve 21 should be activated to control the passage and bypassing for the water cooler 4 so as to adjust the discharge air temperature (water temperature) to a set temperature or that the motor 6 should be controlled in the number of revolutions which drives a cooling fan 7 for the air-cooling water cooler 4 so as to change its airflow volume and adjust water cooling.

Figure 6:
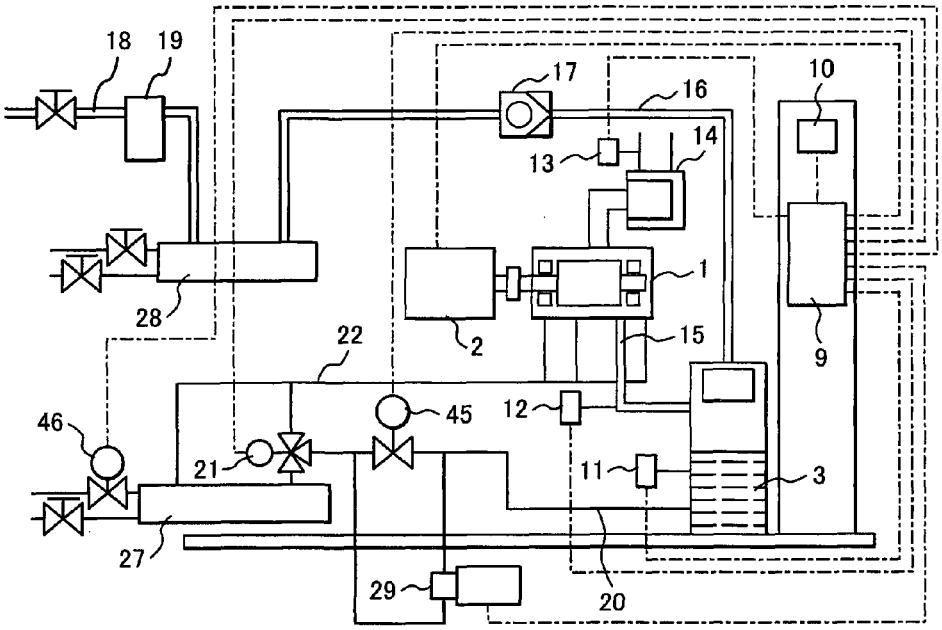
FIG. 6 is a block diagram illustrating the system composition in another embodiment of the present invention.

FIG. 6 shows an embodiment in which water cooling is performed by a water cooling water cooler 27. The water in a separator 3 is supplied by the internal pressure of the separator 3 through a water supply line 20, cooled down by the water cooling water cooler 27 and then sent through a water injection line 22 to the compression cavity of a compressor 1.

The compressor 1, in which water lubricated bearings are used, is short of pressure inside the separator at the time of the activation of the compressor 1 for water quality control, so a pump 29 provided between the water supply line 20 and the water cooling water cooler 27 gives increased pressure and supplies water to the bearings of the water-injected compressor 1. The compressor 1 takes air in through an admission port 14 having an inlet air filter, compresses the air, discharges the air from a discharge port to the separator 3 via a discharge line 15 along with the water injected during the compression process. The separator 3 separates water from the compressed air. The water is stored in the lower part of the separator 3 and then re-supplied through the water supply line 20 to the compressor 1.

The compressed air is separated by the separator 3, sent through an air discharge line 16 connected to the upper part of the separator 3, cooled down by an after cooler 28, separated from condensed drain (water) by a drain separator 19 and then discharged to an precinct line 18.

At the time of a comparatively long stop, for example at night or on holidays, the water-injected compressor 1, as shown in FIG. 2, when staying longer than a predetermined pausing time duration toff 23, becomes automatically activated and operates for a set time duration ton 24 for the purpose of water quality control. Afterwards, the compressor repeats pausing and operation until the water-injected compressor 1 is restarted.

The stopping and operation of the compressor 1 will be further explained with reference to FIG. 6. The water-injected compressor includes a console 9 for operating and controlling the entire unit, which allows driving the driving motor 2 of the water-injected compressor and the motor for the pump 29. The console 9 also allows operating a bypass-line solenoid valve 45 which opens and closes in accordance with the operation of the pump 29 for use in increasing water in pressure at the time of starting and a three-directions solenoid valve 21 for switching between the line for cooling the water supplied to the compressor 1 through the water cooling water cooler 27 and a water injection line 22 for supplying water to the compressor 1 directly without cooling the water down through the water cooling water cooler 27.

The admission port 14 has an atmosphere (intake) temperature detection sensor 13, a separator temperature detection sensor 11 and a discharge air temperature detection sensor 12 for detecting the temperature of the air discharged by the compressor 1, by which the console 9 allows detecting the temperatures of the portions. In addition, using a timer 10 the console 9 allows measuring a starting time point and a stopping time point of the compressor 1.

Further, the console 9, as shown in FIG. 3, is provided with a memory device for storing the data resulting from the setting of operating time durations and pausing time durations in accordance with detected intake temperatures. Now, with reference to FIG. 4, the operation procedure for the water-injected compressor 1 will be explained.

For a routine for ordinary operation, the compressor 1 activates (Step 31). When at the end of daily operating time the supply of compressed air to lines stops, the compressor stops (Step 32). Then, with the console 9 having a memory device not shown in the drawings the timer 10 is employed to store a stopping time point to (Step 33) and to detect atmosphere temperature (intake air temperature) Ta or the temperature of the water inside the separator Tw (Step 34) and store the temperature. The resultant atmosphere temperature Ta or water temperature Tw is used based on the data stored in the memory device to set a pausing time duration toff and an operating time duration ton of the compressor 1 for the atmosphere temperature Ta or for the water temperature Tw (Step 35). Afterwards, the timer 10 is employed to detect an elapsed time point t (Step 36). If the pausing time duration exceeds the set time duration (Step 38), the water-injected compressor 1 activates (Step 39).

Then, a starting time point is detected (Step 40), and an elapsed time point is detected on a regular basis. If the operating time duration exceeds the set time duration ton, the compressor stops. Then, it is decided whether or not the compressor 1 has started by pressing its ordinary activation switch (Step 44). If the ordinary activation switch is pressed, the ordinary continuous operation starts (Step 31). If the switch is not pressed, the repetition of pause and operation starts for water quality control (the procedure goes back to Step 33). Note that controlling the discharge air temperature is performed by varying using a solenoid valve 46 the cooling water volume in the water cooler 27.

The compressor 1 is secured from high discharge temperature by having its casing, rotors, bearings and shaft seals having enough thermo-stability for use at set discharge temperatures. The clearances between rotors, between rotor and casing and between bearing diameters have sufficient values for no damage to occur during operation at set discharge temperatures. The lines, separator, seal materials, solenoid valves and temperature detection sensors also have enough thermo-stability for operation at set discharge temperatures.

As described so far, the water-injected compressor stops and then, if staying at a stop for a predetermined duration of time, namely, a duration long enough for bacteria/germs to propagate without the compressor portion 1 activating, becomes regularly activated and stopped with the advantage that the absence of water remaining intact for a long duration of time in the separator 3, the water lines and the compressor portion 1 along with high water temperatures prevents bacteria/germs from growing in the water inside the separator and in the devices.

Besides, atmosphere temperature or the temperature of the separator 3 is detected, and in accordance therewith operating time durations and their intervals for the water-injected compressor are set. So, even in summertime, a season particularly favorable to the propagation of bacteria/germs, it is possible to unfailingly prevent bacteria/germs from growing.

Further, in wintertime when the atmosphere temperature is low, a season unfavorable to the propagation of bacteria/germs, extending the interval between starting time points for the water-injected compressor leads to the advantage of saving the driving energy of the compressor needed for water quality control.

Further, when the water-injected compressor operates for water quality control, it is possible that the sterilization effect on water is further increased by the operation with the temperature of discharge air from the compressor portion 1 being higher than a set temperature for ordinary operation and thus with the water temperature nearing the discharge temperature. Note that the operation for water quality control at a discharge air temperature of 85° C. or higher for 15 minutes or longer ensures the sterilization effect on the water.

Further, the water-injected compressor has the compressor portion 1, separator 3 and lines so composed as to have enough thermo-stability for the operation at set high discharge temperatures and has appropriately set clearances. This prevents such main parts of the compressor 1 as the bearings, rotors and casing from being expanded or affected thermally, thus from damages like deformations and contacts and function impairments like decreases of compression performance and leakages.

Figure 7:
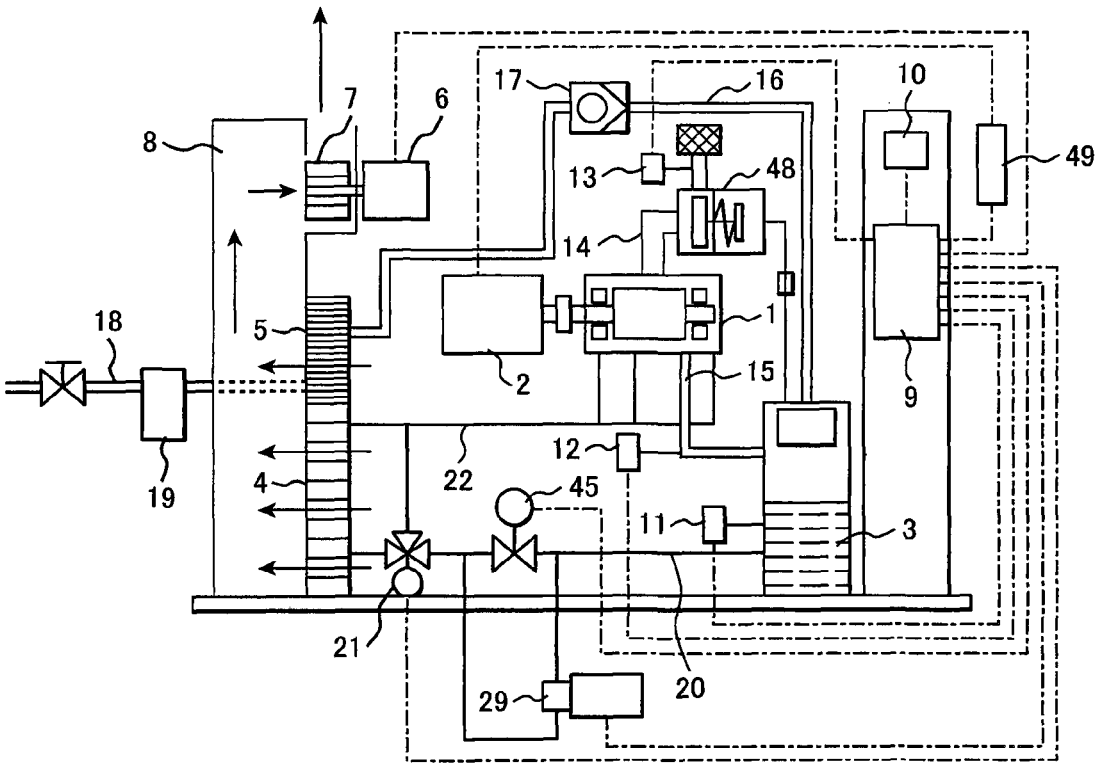
FIG. 7 is a block diagram illustrating the system composition in a third embodiment of the present invention.

With reference to FIG. 7, now, another embodiment of the present invention will be described. The system shown in FIG. 7 including a water-injected compressor 1 and its peripheral composition is the same with regard to principal composition as that shown in FIG. 1. In this embodiment, the compressor 1 or the volume control mechanism provided on its periphery performs volume control. Operating the compressor portion 1 implements energy saving during water quality control. For example, the compressor portion 1 has a suction unloader (restricting mechanism) 48 provided at the admission port thereof to restrict the air volume. Decreasing the air intake or the compressor 1 cuts down the operational power of the compressor portion 1.

Besides, when an inverter 49 for feeding alternating current to a motor 2 driving the compressor portion 1 to perform the control of the number of revolutions is employed for the operation for water quality control, having the number of revolutions of the motor 2 smaller to drive the compressor portion 1 allows cutting down the operational power of the compressor portion 1.

Figure 8:
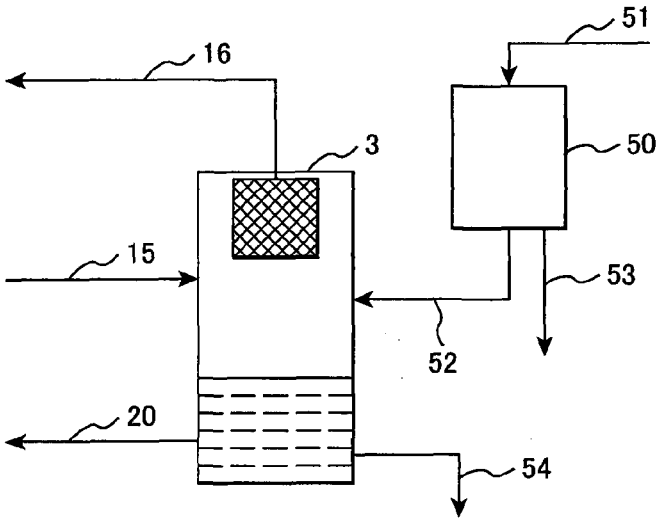
FIG. 8 is a block diagram illustrating another composition related to water quality control.

With reference to FIG. 8, now, another composition related to water quality control will be explained. A water purifying device 50 employing reverse osmoses membranes is connected through a make-up feed water line 52 to a separator 3. The water purifying device 50 is connected to a water supply line 51 and to a drain line 53 for draining salt-containing water not sent through the reverse osmoses membranes (not shown in the drawing). Operating the compressor 1 for sterilization, draining the water inside the separator 3 from a drain line 54 and also feeding the water purified by the water purifying device 50 through the make-up feed water line 52 allows getting rid of water deteriorated in quality, saving the operating time of the compressor 1, cutting down the operational power of the compressor portion 1 and thus obtaining energy saving effects.

Figure 9:
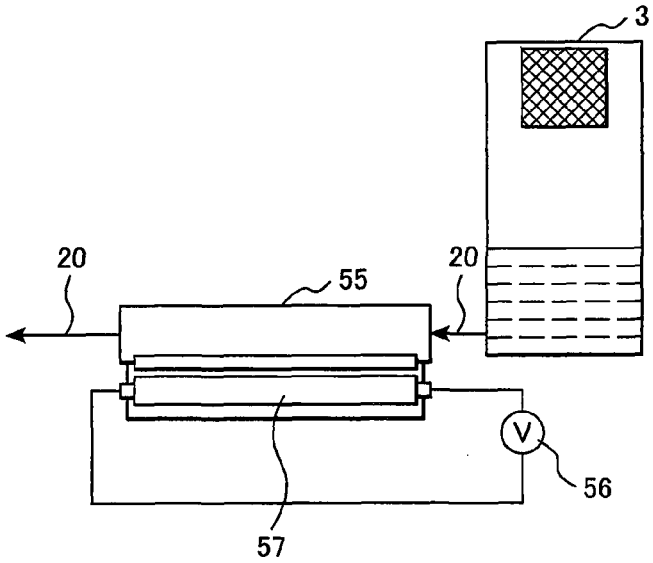
FIG. 9 is a block diagram illustrating a third composition related to water quality control.

With reference to FIG. 9, a third composition related to water quality control will be explained. Halfway through a water supply line 20 connected to the separator 3 is installed an ultraviolet sterilizer 55. The ultraviolet sterilizer 55 has a flow path connected to the water supply line 20 and an ultraviolet emission lamp 57 installed on this flow path to emit ultraviolet light. The ultraviolet emission lamp 57 is fed with electricity by a power source 56 to emit light. The ultraviolet light is directed through an ultraviolet light transmission portion not shown in the drawing and is emitted into the water going in the flow path. The sterilization of the water with ultraviolet light saves the operating time of the compressor portion 1 and thus obtains energy saving effects.

What is claimed is:

1. A water-injected compressor comprising:

a compressor portion driven by a motor for compressing air taken into the compressor;

a water supply passage means for supplying water to the compressor portion;

a separator communicated with the compressor portion for separating water and air in the compressed air discharged from the compressor portion;

a timer for detecting an elapsed time point and calculating a pausing time duration;

a sensor for detecting a water temperature in the separator;

a sensor for detecting an atmosphere temperature;

a console for detecting a starting time point and a stopping time point of the compressor portion to calculate pausing time duration; and a memory associated with the console for storing a set operating time duration and a plurality of set pausing time durations for the compressor portion that successively decrease as the detected atmosphere temperature increases, wherein the compressor portion activates when the pausing time duration calculated exceeds one of the set pausing time durations.

2. The water-injected compressor according to claim 1, which further comprises a water injection line for supplying the water inside the separator to the compressor portion and a water cooler provided between the water injection line and the compressor portion for cooling down the water inside the separator thereby decreasing the cooling volume of the water cooler during the set operating time duration for the compressor portion.

3. The water-injected compressor according to claim 1, which further comprises a sensor for detecting the temperature of the air discharged by the compressor portion thereby maintaining a discharge air temperature of 85° C. or higher for 15 minutes or longer for the compressor portion during the set operating time duration for the compressor portion.

4. The water-injected compressor according to claim 1, which further comprises a water injection line for supplying the water inside the separator to the compressor portion and a water cooler provided between the water injection line and the compressor portion for cooling down the water inside the separator, wherein the water cooler uses external water to cool down water from the separator, and the volume of the water sent to the water cooler varies.

5. The water-injected compressor according to claim 1, wherein after stopping the compressor portion, if the compressor portion stays stopped for a predetermined duration of time without receiving an activation request, the compressor portion becomes activated and operates while controlling the compression volume of the compressor portion.

6. The water-injected compressor according to claim 5, which further comprises a restricting mechanism at an admission port of the compressor portion so as to change the air intake of the compressor.

7. The water-injected compressor according to claim 1, which further comprises an inverter for feeding alternating current to the motor for driving the compressor thereby controlling the number of revolutions of the driving motor.

8. The water-injected compressor according to claim 1, which further comprises a water purifying device having reverse osmosis membranes and a make-up feed water line connecting the water purifying device to the separator, wherein after stopping the compressor portion, if the compressor portion stays at a stop for a predetermined duration of time without receiving an activation request, the compressor portion is activated and operates for a set duration of time while draining the water inside the separator and also feeding the water purified by the water purifying device through the make-up feed water line to the separator.

9. The water-injected compressor according to claim 1, which further comprises an ultraviolet sterilizer provided for a line between the separator and the compressor portion.

10. A water-injected compressor comprising:

a compressor portion into which water is injected;

a separator communicated with the compressor portion for separating water and air in the compressed air discharged from the compressor portion;

a sensor for detecting a water temperature in the separator;

a sensor for detecting an atmosphere temperature;

a sensor for detecting the temperature of the air discharged by the compressor portion;

a console for controlling the compressor portion and detecting a starting time point and a stopping time point of the compressor portion to calculate pausing time duration; and a memory associated with the console for storing a set operating time duration and a plurality of set pausing time durations for the compressor portion that successively decrease as the detected atmosphere temperature increases, wherein the compressor portion activates when the pausing time duration calculated exceeds one of the set pausing time durations.

11. The water-injected compressor according to claim 10, which further comprises a water injection line for supplying the water inside the separator to the compressor portion and a water cooler provided between the water injection line and the compressor portion for cooling down the water inside the separator, wherein the water cooler uses external water to cool down the water from the separator, and the volume of the water sent to the water cooler varies.

12. The water-injected compressor according to claim 10, wherein after stopping the compressor portion, if the compressor portion stays stopped for a predetermined duration of time without receiving an activation request, the compressor portion becomes activated and operates while controlling the compression volume of the compressor portion.

13. The water-injected compressor according to claim 12, which further comprises a restricting mechanism at an admission port of the compressor portion so as to change the air intake of the compressor.

14. The water-injected compressor according to claim 10, which further comprises an inverter for feeding alternating current to the motor for driving the compressor thereby controlling the number of revolutions of the driving motor.

15. The water-injected compressor according to claim 10, which further comprises a water purifying device having reverse osmosis membranes and a make-up feed water line connecting the water purifying device to the separator, wherein after stopping the compressor portion, if the compressor portion stays at a stop for a predetermined duration of time without receiving an activation request, the compressor portion is activated and operates for a set duration of time while draining the water inside the separator and also feeding the water purified by the water purifying device through the make-up feed water line to the separator.

16. The water-injected compressor according to claim 10, which further comprises an ultraviolet sterilizer provided for a line between the separator and the compressor portion.

17. The water-injected compressor according to claim 10, which further comprises a timer for detecting an elapsed time point and calculating a pausing time duration.

18. The water-injected compressor according to claim 10, which further comprises a memory associated with the console for storing data resulting from the setting of operating time durations and pausing time durations for compressor portion in accordance with the detected temperatures.

* * * * *